US005388302A

United States Patent [19]

Sundaram et al.

[11] Patent Number: 5,388,302

[45] Date of Patent: Feb. 14, 1995

[54] VACUUM CLEANER HOUSING AND AIRFLOW CHAMBER

[75] Inventors: Kamala J. Sundaram, Milford; Ronald S. Hemmann, Newington; Paul H. Johnson, Fairfield, all of Conn.

[73] Assignee: Black & Decker Inc., Newark, Del.

[21] Appl. No.: 1,827

[22] Filed: Jan. 8, 1993

[51] Int. Cl.[6] ..... A47L 5/24

[52] U.S. Cl. ..... 15/344; 15/412

[58] Field of Search ..... 15/344, 327.2, 405, 15/412

[56] References Cited

U.S. PATENT DOCUMENTS

| | | | |
|---|---|---|---|
| D. 162,312 | 3/1951 | Karstadt | 15/344 |
| D. 303,170 | 8/1989 | Hirano | D32/18 |
| D. 315,623 | 3/1991 | Bartasevich | D32/18 |
| D. 315,816 | 3/1991 | Ferrari | D32/18 |
| 1,210,523 | 1/1917 | Orr . | |
| 1,211,786 | 1/1917 | Taylor et al. . | |
| 1,230,206 | 6/1917 | Niemeyer . | |
| 1,689,580 | 10/1928 | Daddio | 15/344 |
| 1,878,858 | 9/1932 | Kitto . | |
| 1,944,950 | 1/1934 | Riebel, Jr. | 15/9 |
| 2,053,563 | 9/1936 | Kirby . | |
| 2,054,975 | 9/1936 | Goldberg | 15/9 |
| 2,073,489 | 3/1937 | Leathers | 183/36 |
| 2,126,396 | 8/1938 | Kitto | 15/6 |
| 2,140,143 | 12/1938 | Sellers | 15/9 |
| 2,143,018 | 1/1939 | Kitto | 15/9 |
| 2,190,882 | 2/1940 | Pardee | 15/9 |
| 2,210,951 | 8/1940 | Replogle | 248/1 |
| 2,225,621 | 12/1940 | Burkhardt | 15/6 |
| 2,244,165 | 6/1941 | MacFarland | 183/63 |
| 2,309,583 | 1/1943 | Frantz | 15/16 |
| 2,335,031 | 11/1943 | Stevens | 220/56 |
| 2,491,007 | 12/1949 | Koch | 69/20 |
| 2,876,481 | 3/1959 | Gerber et al. | 15/331 |
| 2,898,622 | 8/1959 | Hurd | 15/333 |
| 2,960,713 | 11/1960 | Wistrand | 15/344 |
| 3,321,794 | 5/1967 | Jepson et al. | 15/337 |
| 3,327,194 | 9/1967 | Jepson et al. | 15/323 |
| 3,359,025 | 12/1967 | Nilsson | 292/117 |
| 3,564,641 | 2/1971 | Meyer | 15/323 |
| 3,695,006 | 10/1972 | Valbona et al. | 15/344 |
| 3,708,823 | 1/1973 | Bell | 15/340 |

(List continued on next page.)

FOREIGN PATENT DOCUMENTS

| | | |
|---|---|---|
| 3309162 | 3/1983 | Germany . |
| 405636 | 4/1963 | Switzerland . |
| 538613 | 2/1940 | United Kingdom . |
| 2028111 | 3/1980 | United Kingdom . |

*Primary Examiner*—David A. Scherbel
*Assistant Examiner*—James F. Hook
*Attorney, Agent, or Firm*—Barry E. Deutsch

[57] ABSTRACT

A vacuum cleaner with a housing, a source of vacuum, and an air chamber located in the housing and connected to the source of vacuum. The housing includes a bottom member, a top member and a handle contacting and extending from a top surface of the top member. The handle is separately connected to the bottom member such that the handle is supported by both the top and bottom members. The air chamber is located in the housing between the top and bottom members with an inlet aperture and an exhaust aperture located at the exterior of the housing. The air chamber is comprised of two half sections that combine to form an inlet conduit, an outlet conduit, and an impeller chamber. An impeller of the source of vacuum is located in the impeller chamber. The source of vacuum has a motor with a first end connected to the impeller and a second end forming a drive shaft to drive a belt connected to a rotatable brush assembly.

15 Claims, 5 Drawing Sheets

U.S. PATENT DOCUMENTS

| | | | |
|---|---|---|---|
| 3,730,642 | 5/1973 | Barnstead | 417/424 |
| 3,879,797 | 4/1975 | Principe | 15/334 |
| 3,936,903 | 2/1976 | Johnson | 15/331 |
| 4,204,298 | 5/1980 | Handa et al. | 15/344 |
| 4,288,886 | 9/1981 | Siegler | 15/330 |
| 4,357,730 | 11/1982 | Lex | 15/344 |
| 4,380,845 | 4/1983 | Miller et al. | 15/344 |
| 4,446,594 | 5/1984 | Watanabe | 15/323 |
| 4,446,595 | 5/1984 | Nakada et al. | 15/365 |
| 4,472,856 | 9/1984 | Goodin | 15/337 |
| 4,490,882 | 1/1985 | Wells | 15/337 |
| 4,519,113 | 5/1985 | Hipple | 15/335 |
| 4,563,790 | 1/1986 | Clark | 15/337 |
| 4,571,772 | 2/1986 | Dyson | 15/335 |
| 4,581,787 | 4/1986 | Torigoe | 15/351 |
| 4,633,543 | 1/1987 | Sovis et al. | 15/344 |
| 4,637,092 | 1/1987 | Hayashi | 15/319 |
| 4,644,605 | 2/1987 | Joss et al. | 15/329 |
| 4,648,150 | 3/1987 | Morishita | 15/389 |
| 4,660,246 | 4/1987 | Duncan et al. | 15/329 |
| 4,674,146 | 6/1987 | Tuggle et al. | 15/344 |
| 4,686,736 | 8/1987 | Petralia | 15/332 |
| 4,741,070 | 5/1988 | Sovis et al. | 15/344 |
| 4,748,714 | 6/1988 | Tachudy | 15/390 |
| 4,776,059 | 10/1988 | Worwag | 15/334 |
| 4,778,740 | 12/1988 | Sovis et al. | 15/339 |
| 4,799,286 | 1/1989 | Rubin | 15/361 |
| 4,811,450 | 3/1989 | Steadings | 15/337 |
| 4,811,452 | 3/1989 | Sumerau | 15/337 |
| 4,891,861 | 1/1990 | Sovis et al. | 15/344 |
| 4,918,857 | 4/1990 | Wade et al. | 15/344 |
| 4,942,641 | 7/1990 | Gerke, Jr. | 15/338 |
| 4,955,106 | 9/1990 | Stein et al. | 15/335 |
| 4,959,885 | 10/1990 | Sovis et al. | 15/335 |
| 5,028,245 | 7/1991 | Stein et al. | 55/373 |
| 5,105,505 | 4/1992 | Reed, Jr. | 15/344 |
| 5,129,128 | 7/1992 | Bowerman | 15/413 |

VACUUM CLEANER HOUSING AND AIRFLOW CHAMBER

BACKGROUND OF THE INVENTION

1. Field of the Invention

The present invention relates to vacuum cleaners and, more particularly, to a new housing and airflow conduit system through the housing.

2. Prior Art

U.S. Pat. No. 2,054,975 discloses a hand-held vacuum cleaner having an annular shutter to manipulate the direction of dirty air. An inlet and outlet are located near each other at the rear of the unit. U.S. Pat. No. 2,491,007 discloses a hand-held vacuum cleaner with a two part casing, a motor having a pulley at one end to a drive roller, and a fan at an opposite end. U.S. Pat. No. 1,944,950 discloses a convertible suction cleaner that can convert from a floor to a hand-held unit. The inlet and outlet nozzles are located near each other and perpendicular to the axis of the fan. U.S. Pat. Nos. 4,811,450 and 4,660,246 disclose fan casings with an outer wall that can be adapted for a hose connection having a vertical intake nozzle. U.S. Pat. No. 3,273,194 discloses a casing with a forward section and a channel shaped member that define a housing for an air impeller with a cover. Other relevant art includes U.S. Pat. Nos. 2,225,621; 2,053,563; 1,210,523; 2,126,396; 2,140,143; 2,190,882; 2,210,951; 2,876,481; 2,898,622; 3,321,794; 4,519,113; 4,944,106; 4,959,885; 5,028,245; and 5,129,128.

SUMMARY OF THE INVENTION

In accordance with one embodiment of the present invention a vacuum cleaner is provided comprising a housing, a source of vacuum, and an air chamber. The source of vacuum is located in the housing and includes a motor and an impeller. The air chamber is connected to the housing and surrounds the impeller. The air chamber is comprised of at least two half sections that form an inlet conduit, an impeller chamber, and an outlet conduit. The inlet conduit has a substantially constant cross sectional area along its length.

In accordance with another embodiment of the present invention a vacuum cleaner is provided comprising a housing, a motor, a rotatable brush, a drive belt, and an air chamber. The motor is connected to the housing and includes a first end with a vacuum impeller connected thereto and an opposite second end forming a drive shaft. The rotatable brush assembly is connected to the housing. The drive belt is connected between the rotatable brush assembly and the drive shaft of the motor. The air chamber is connected to the housing and surrounds the vacuum impeller. The air chamber has an inlet aperture and an exhaust aperture located at the exterior of the housing.

In accordance with another embodiment of the present invention, a vacuum cleaner housing is provided comprising a first member, a second member, and a handle. The second member is connected to the first member and forms a general chamber therebetween. The handle extends from and contacts an exterior surface of the second member. The handle is separately attached to the first member through the general chamber such that the handle is supported by both of the first and second members.

In accordance with another embodiment of the present invention a vacuum cleaner conduit assembly is provided comprising a first half section, and a second half section. The second half section is connected to the first half section and forms an inlet conduit, an impeller chamber, and an outlet conduit. The first and second half sections are adapted to be located in and connected to the housing of the vacuum cleaner, substantially surround the impeller in the impeller chamber, and provide a substantially closed air flow pathway inside the housing to help prevent dirt from contaminating the motor.

BRIEF DESCRIPTION OF THE DRAWING

The foregoing aspects and other features of the invention are explained in the following description, taken in connection with the accompanying drawings, wherein.

DETAILED DESCRIPTION OF THE INVENTION

Figure 1:
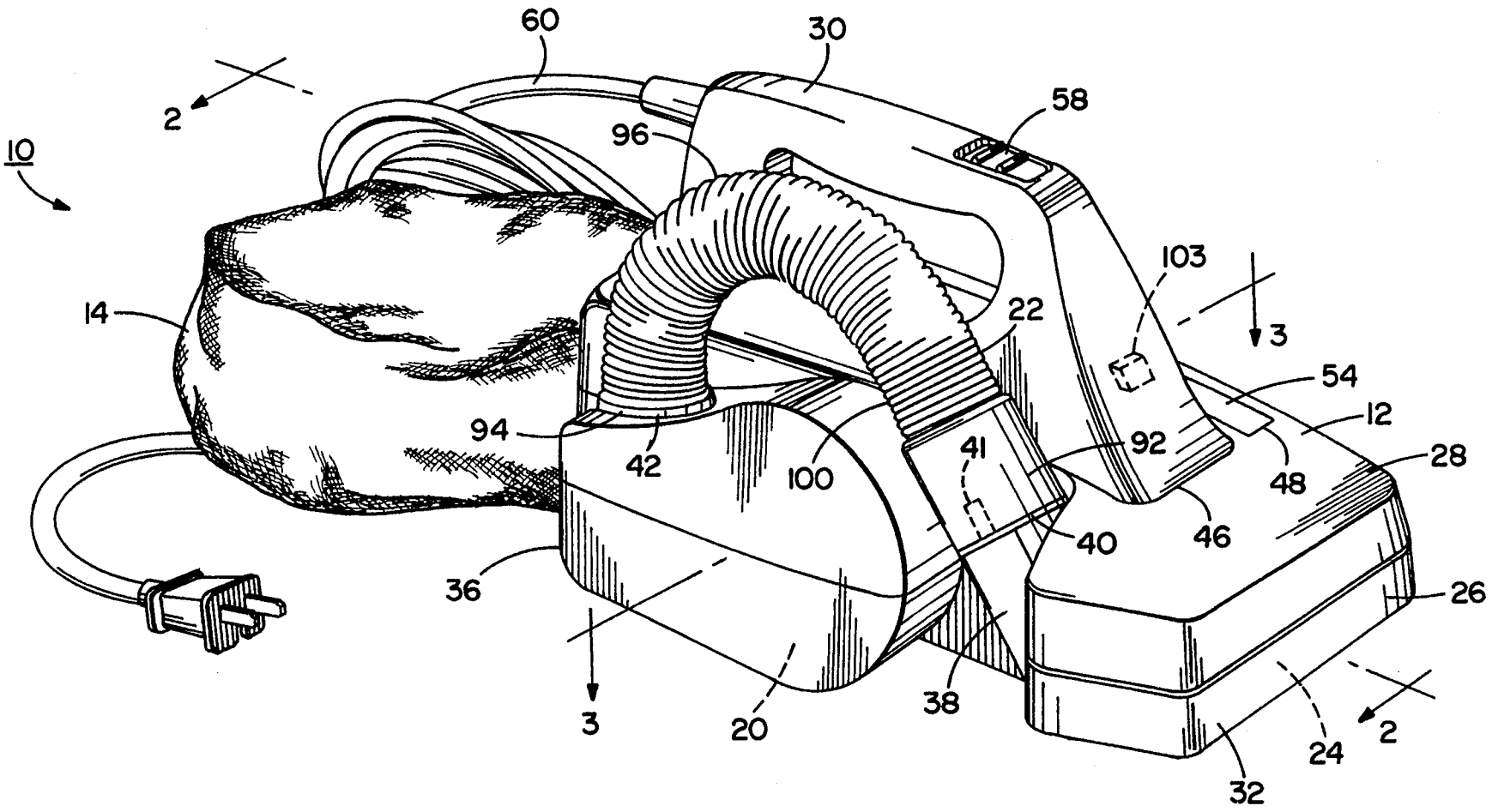
FIG. 1 is a perspective view of a vacuum cleaner incorporating features of the present invention.

Referring to FIGS. 1–4, there is shown a vacuum cleaner 10 incorporating features of the present invention. Although the present invention will be described with reference to the embodiments shown in the drawings, it should be understood that the present invention may be embodied in any alternative forms of embodiment. In addition, any suitable size, shape or type of elements or materials may be used.

Figure 2:
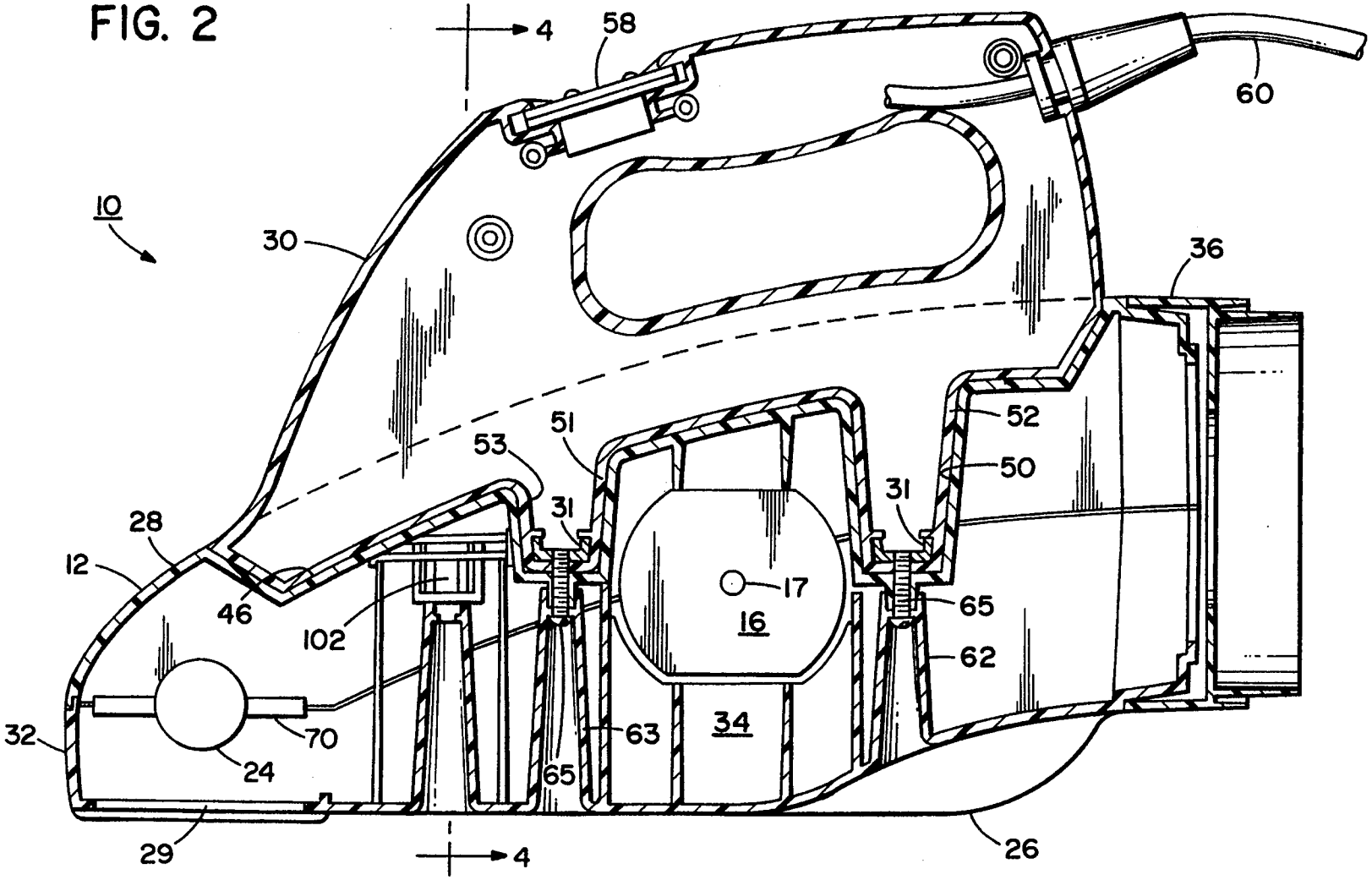
FIG. 2 is a schematic cross-sectional view of the vacuum cleaner shown in FIG. 1 taken along line 2— 2, less the dirt bag.
Figure 4:
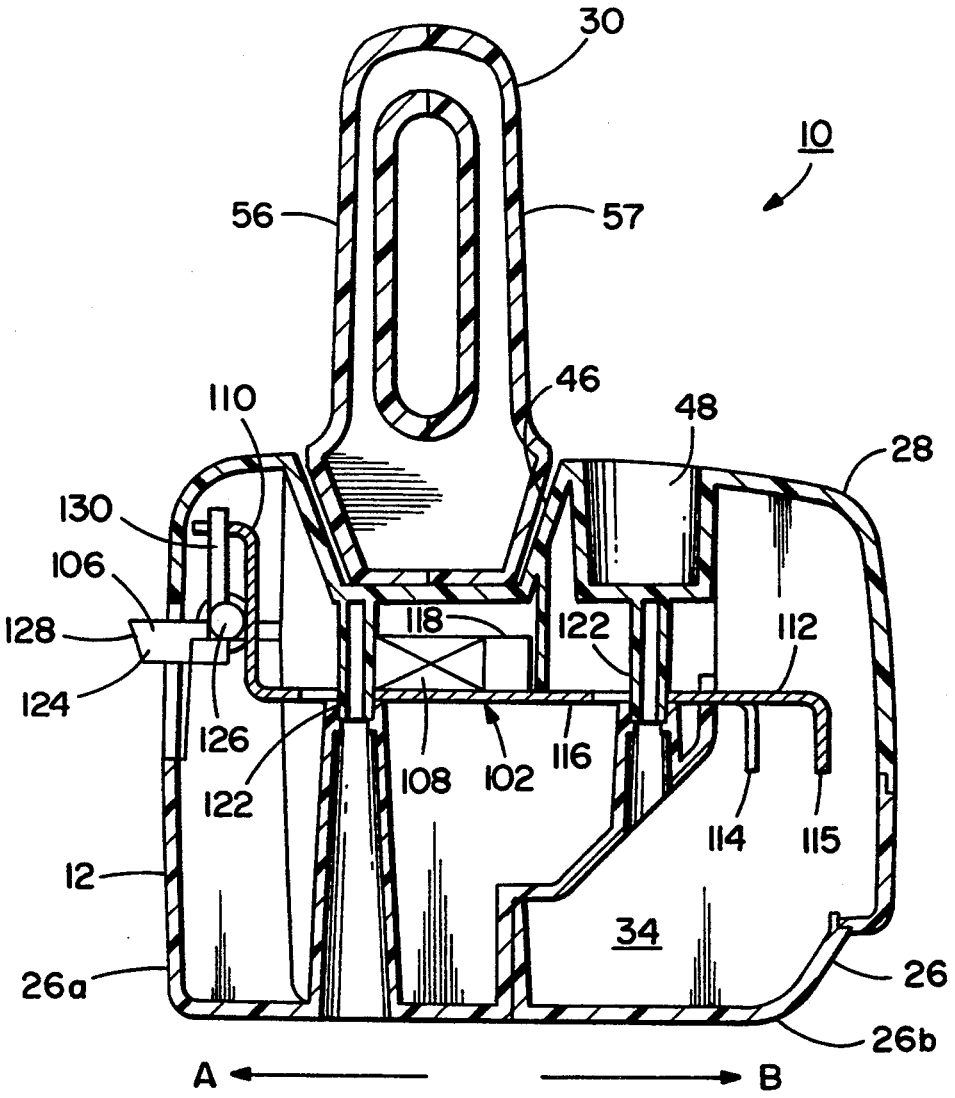
FIG. 4 is a schematic cross-sectional view of the vacuum cleaner shown in FIG. 2 taken along line 4—4.

The vacuum cleaner 10, in the embodiment shown, is a portable hand-held vacuum cleaner also known as a hand-vac. However, features of the present invention may be incorporated into other types of vacuum cleaners, such as uprights or central vacuum cleaner systems. The vacuum cleaner 10 generally comprises a housing 12, a dirt bag 14, a motor 16, an impeller or fan 18, an airflow chamber 20, a hose 22, and a rotatable brush assembly 24. The housing 12, in the embodiment shown, generally comprises a bottom housing 26, a top housing 28 and a handle 30. The bottom housing 26 has a one-piece molded polymer or plastic member **26*a* and a cover 26*b*. The cover 26*b* is removably connected to the member 26*a* to provide easy access to the belt 66. However, a single one-piece bottom housing could be provided. The top housing 28 is preferably made of a one-piece molded polymer or plastic material. The bottom and top housings 26 and 28 are connected to each other by suitable means such as screws 27 and form an intake section 32, a general chamber 34 therebetween for housing the motor 16 and airflow chamber 20, and a rear end 36 adapted to have the dirt bag 14 removably connected thereto. Of course, the top and bottom housings 28 and 26 could have any suitable shape or be comprised of multiple members. The housing members 26*a*, 26*b*, and 28 and handle 30 form a unitary substantially rigid housing. The bottom housing 26 includes inlet vent holes (not shown) to allow cooling air to access the motor 16 and an opening 29 at the intake section 32 to allow the brush assembly 24 to have access outside of the housing. The bottom housing 26 also forms part of a nozzle 38 at the intake section 32 that the front end of the hose 22 is connected to. The top housing 28 also forms part of the nozzle 38 with a collar 40 being provided to give the nozzle 38 a good surface for the front end of the hose 22 to seal and seat against. The nozzle 38 forms a conduit to the interior of the intake section 32 where the brush assembly 24 is located. The top housing 28 also includes a second nozzle 42 located proximate the rear end 36 of the housing that the second end of the hose 22 is connected to. In addition, the top housing 28 has exhaust vents (not shown), a handle recess 46, and an accessory recess 48. The exhaust vents are provided to allow hot air to exit the chamber 34. The handle recess 46 is provided along the center axis of the top housing 28 and is adapted to receive the bottom portion of the handle 30. As can be seen in FIG. 2, the recess 46 has deep sections 50, 51 to accommodate the handle bottom projections 52, 53. The recess 46 has general wedge shaped walls to provide a good seat for the handle 30 and add structural rigidity to the top housing 28. The accessory recess 48, seen best in FIG. 4, is located on the opposite side of the handle 30 than the hose 22. The recess 48 is adapted to removably house an accessory tool 54, such as a crevice tool, adapted to be used with the hose 22. Suitable means (not shown) are provided to removably attach the tool 54 in the recess 48 such as a leaf spring that biases the tool 54 against a wall in the recess 48. The handle 30, in the embodiment shown, is comprised of two half sections 56, 57, a control switch 58, and wiring 60 to deliver electricity from an electrical outlet to the motor 16**. Of course, features of the invention could be incorporated into a battery operated vacuum cleaner.

In the embodiment shown, due to the fact that the top housing 28 is made of a molded polymer or plastic material and has features such as accessory recess 48 and exhaust vents, a novel method of attaching the handle 30 to the top and bottom housings 28, 26 is provided. As seen in FIG. 2, the bottom housing 26 has screw columns 62, 63 that extend upward into the chamber 34. The screw columns 62, 63 are located near the bottom of the deep sections 50, 51. Screws 65 are screwed into the screw columns 62, 63, through the bottoms of the deep sections 50, 51, and into the handle bottom projections 52, 53. The handle 30 includes interior metal brackets 31 at the bottom projections 52,53 that the screws 65 are screwed into. This arrangement sandwiches a portion of the top housing 28 between the handle bottom projections 52, 53 and the screw columns 62, 63 and, the handle is directly connected to both of the bottom and top housings to better support the handle 30.

The motor 16 includes a drive shaft 17 that has a first end with the impeller 18 connected to it and opposite second end 64 that functions as a drive for the belt 66. The motor 16 includes a small fan 68 to assist in drawing cooling air across the motor 16 to cool the motor. The belt 66 is provided to drive the brush assembly 24. The brush assembly 24 includes a rotatable brush 70, a drive pulley 72, and an idler 74. In a preferred embodiment, the drive pulley 72 is integrally formed with a dowel of the brush 70 as a molded one-piece member and brush bristles are then inserted into the brush dowel. However, the drive pulley and brush dowel could be comprised of separate members. The belt 66 extends between the second end 64 of the motor drive shaft to the pulleys 72, 74 and functions as a transmission to allow the motor 16 to drivingly rotate the brush 70. The transmission for the brush assembly 24 and other features are discussed in more detail further below.

The impeller 18, motor 16 and chamber 20 combine to function as a source of vacuum for the vacuum cleaner 10. In the embodiment shown, the vacuum cleaner 10 is a direct air system also known as a dirty fan system. A direct air system or dirty fan system is a system that has its impeller in direct contact with air and dirt vacuumed up at the intake section 32. A clean fan system is a system that separates the vacuumed air from the entrained dirt prior to the air reaching vacuum impeller. Although the present invention is being described in the context of a dirty fan system, it should be understood that certain features of the present invention may be incorporated into clean fan systems. In the embodiment shown, the vacuum cleaner 10 has been provided with a novel airflow chamber 20. The airflow chamber 20 is basically provided for three reasons; to provide a substantially closed dirty air pathway through the housing 12, to provide an air pathway that is separate from the housing 12, and to enhance airflow characteristics into, through and away from the impeller 18.

Figure 5:
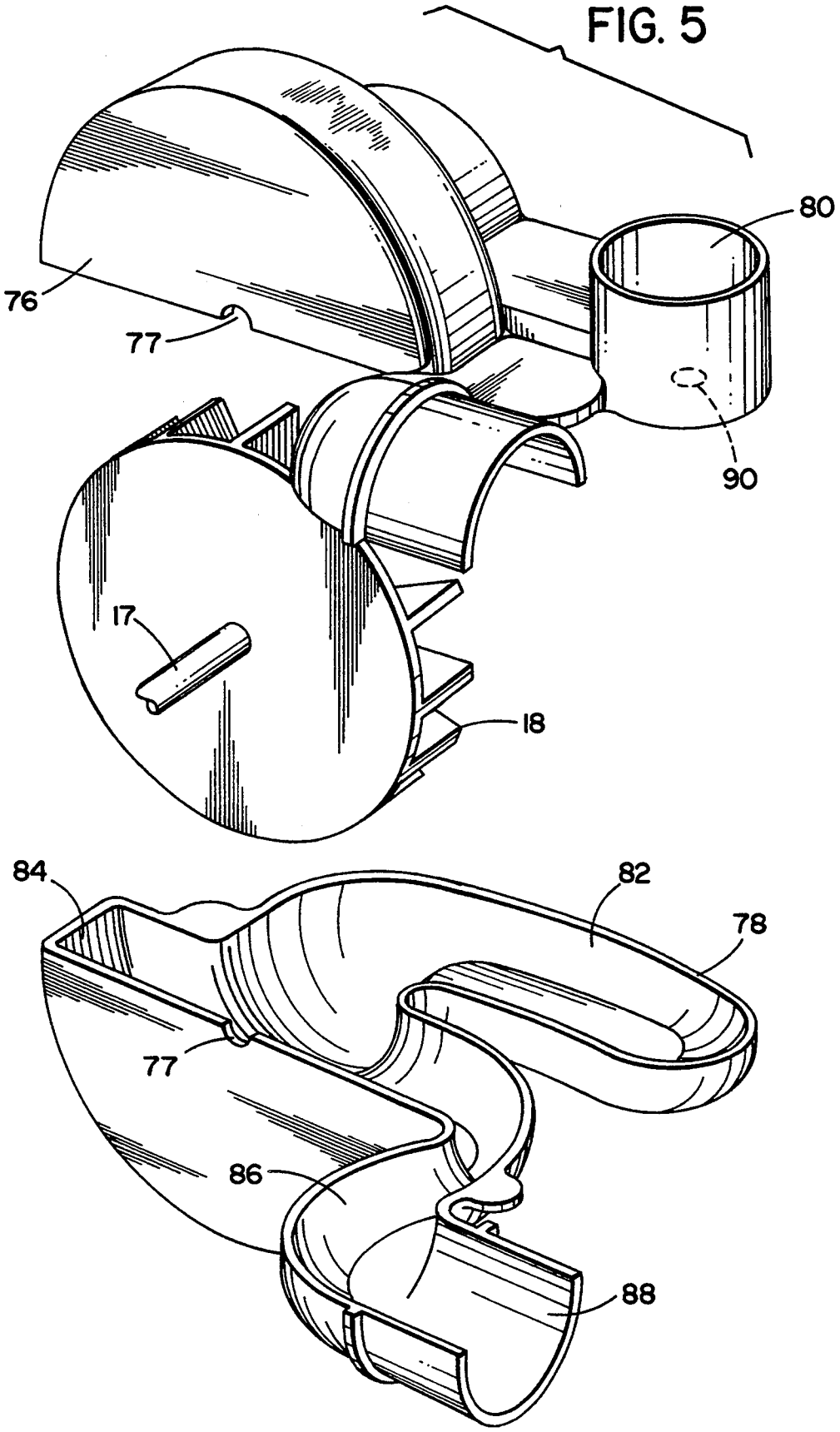
FIG. 5 is an exploded perspective view of the airflow chamber and impeller of the vacuum cleaner shown in FIG. 1.

Referring also to FIG. 5, the airflow chamber 20 is comprised of two half sections; a top member 76 and a bottom member 78. The members 76, 78 are comprised of a molded polymer or plastic material and generally form an inlet 80, an inlet conduit 82, an impeller chamber 84, an exhaust conduit 86, and an outlet 88. The inlet 80, formed entirely from the top member 76, is located in the nozzle 42 proximate the rear end 36 of the housing. The other features (82, 84, 86, 88) are formed by the assembly of the two members 76, 78; each member having half of these features.

In the embodiment shown, the inlet conduit 82 has a general straight tube shape with angularly offset entrance and exit between the inlet 80 and the impeller chamber 84. The two angular redirections at the entrance and exit of the inlet conduit 82 have smooth curves and, the inlet conduit 82 has a substantially uniform cross-sectional area along its length. Preferably, the inlet conduit cross-sectional area is about the same as the cross-sectional area of the conduit in the hose 22. These factors combine to enhance smooth flow of air through the inlet conduit 82 thereby reducing fluid friction head. The inlet conduit 82 opens into the impeller chamber 84 along the impeller's axis of rotation and the exhaust conduit 86 extends out of the impeller chamber 84 perpendicular to the axis of rotation.

The impeller 18 is rotatably located in the impeller chamber 84. The impeller 18 is located in one of the members 76 or 78 and then the other member is connected to capture or enclose the impeller 18 in the impeller chamber 84. Each of the members 76, 78 have a semi-circle hole 77 at the impeller chamber walls that combine to allow the motor's drive shaft 17 to pass through the members 76, 78. A suitable seal is provided (not shown) between the impeller chamber walls and the motor's drive shaft. The walls of the members 76, 78 are suitably shaped and configured to form a seal at their junction. This provides a substantially closed air pathway from the inlet 80 through the airflow chamber 20, and out the outlet 88. In a preferred embodiment, the top member 76 has a hole 90 near the inlet 80 into the inlet conduit 82. This hole is provided such that air can be suctioned from inside the housing 12 into the airflow chamber 20. This can assist the motor fan 68 in removing heat from inside the housing 12 and, thus, help to cool the motor 16. This also assists in removing carbon dust from the motor 16. Because of the vacuum created in the inlet conduit by the impeller 18, air and dirt does not exit the hole 90. This keeps the dirty air separate from the motor and belt transmission. The exhaust conduit 86, unlike the inlet conduit 82, does not have a uniform cross-sectional area. Instead, the exhaust conduit 86 increases in cross-sectional area from the impeller chamber 84 to the outlet 88. The exhaust conduit 86 also has a general "S" shape with smooth curved surfaces. These features combine to both reduce noise emanating from the outlet 88 and, reduce the velocity of air and dirt as it exits the outlet 88. Reducing the velocity of air and dirt as it exits the outlet will help to extend the working life of the dirt bag 14 and also adds safety such as if a nail were vacuumed up by the vacuum cleaner 10, its velocity would be reduced exiting the outlet 88 thereby reducing the risk that the nail would be propelled through the dirt bag 14. The housing 12 is designed to merely capture and hold the members 76, 78 in a fixed relationship between the bottom and top housings 26, 28. Alternatively, the members 76,78 could be screwed to each other or to the housing 12. One of the features of the present invention is that the airflow chamber 20 is separate from the housing 12. In this fashion the chamber 20 can be changed or redesigned without necessarily changing or redesigning the housing 12. Likewise, the housing 12 could be redesigned or restyled without having to redesign the chamber 20. Another feature is the fact that even though the vacuum cleaner 10 has a dirty fan system, the novel airflow chamber 20 provides a substantially closed dirty air pathway through the housing 12. This prevents dirt from interfering with operation of the motor and the brush assembly transmission known to occur in dirty air systems. The novel airflow chamber 20 also allows an enhanced airflow pathway because of the smooth walls and curves, appropriate sizes and dimensions, and relatively short airflow pathway length. The resultant enhanced airflow characteristics allows the motor and impeller to create a stronger vacuum. This combines with the short length of the hose 22, when connected to the intake section 32, to create stronger air power at the intake section 32 than previously provided by hand-held portable vacuum cleaners.

Figure 6:
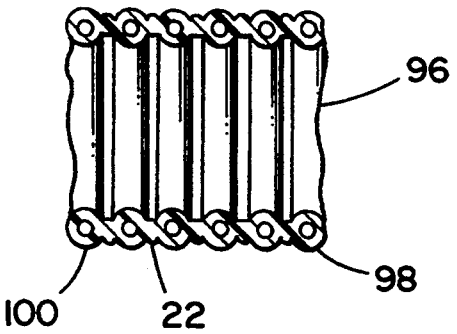
FIG. 6 is a cross-sectional view through the center section of the hose shown in FIG. 1.

The hose 22, in the embodiment shown, generally comprises a front cuff 92, a rear cuff 94, and a flexible and expandable center section 96 between the two cuffs 92, 94. The front cuff 92 is removably mounted on the collar 40 at the intake section 32. The rear cuff 94 is removably mounted in the rear nozzle 42 at the inlet 80 of the airflow chamber 20. The center section 96 (see FIG. 6) is generally comprised of a coiled wire 98 surrounded by a cover 100 comprising a flexible accordion-like expandable resilient polymer material. The coiled wire 98 has spring-like properties in that it has a relatively compact natural state, can be longitudinally elongated as a coil spring, and can return itself back to a compact size. The coiled wire 98 and cover 100 combine to provide an enclosed flexible and expandable conduit that has a relatively compact natural state. In the embodiment shown, the hose 22 has a length of about 8 inchs in its natural state, but is expandable up to about 2½ feet or about three to four times its length in its natural state. However, any suitable lengths could be provided. As shown in FIG. 1, when the two ends of the hose 22 are connected to the nozzles 38, 42 the hose has a relatively compact, free-standing, arch shape. The arch has an angle of about 160° with a substantially smooth gentle curvature along substantially its entire length. This shape allows air and dirt to flow relatively easily through the hose 22 into the airflow chamber 20. Air and dirt can travel into the intake section 32, through the hose 22, through the airflow chamber 20, and into the dirt bag 14. The hose 22 thus functions as the only airflow pathway from the intake section 32 to the airflow chamber 20.

As noted above, the front cuff 92 of the hose 22 is removably attached to the front nozzle 38. Thus, the front end of the hose 22 can be reconfigurably disconnected from the intake section 32 of the housing 12 and repositioned, by bending and expanding the hose, to a desired location up to two and one-half feet away from the housing 12. The crevice tool 54 can be removed from the housing 12 and attached to the free front end of the hose if desired. Preferably, the front cuff 92 is merely snap-fit onto the collar 40 of the nozzle 38. However, a latch 41 such as a leaf spring could be used to help prevent the front cuff 92 from being inadvertently disconnected from the nozzle 38. The rear end of the hose 22 can be disconnected from the rear nozzle 42 such as to gain easy access into the inlet conduit 82, such as if an item gets caught in the inlet conduit 82, or to easily replace the hose 22 if it becomes damaged. Because of the spring-like coil 98 in the hose 22, the user can replace the front end of the hose 22 back onto the front nozzle 42 and the hose 22 will resume its relatively compact, free-standing, arch shape shown in FIG. 1. The spring-like accordion characteristic of the hose 22 allows the hose to be repeatedly expanded and retracted. This combined hand-held portable vacuum and extendable hose combine to provide features that simply were not previously available for hand-held portable vacuums.

As noted above, the vacuum cleaner 10 has a driven rotatable brush 70 located at the intake section 32 of the housing 12. In view of the fact that the front end of the hose 22 can be disconnected from the intake section 32, it is desirable to disengage driving transmission of the brush 70 by the motor 16 when the front end of the hose 22 is disconnected. This prevents damage or harm that might otherwise occur if the driving transmission was not disengaged and the user forgot that the brush 70 was rotating. In the embodiment shown, a system 102 is provided to automatically disengage driving transmission of the brush 70 when the hose 22 is disconnected from the front nozzle 38.

Figure 3:
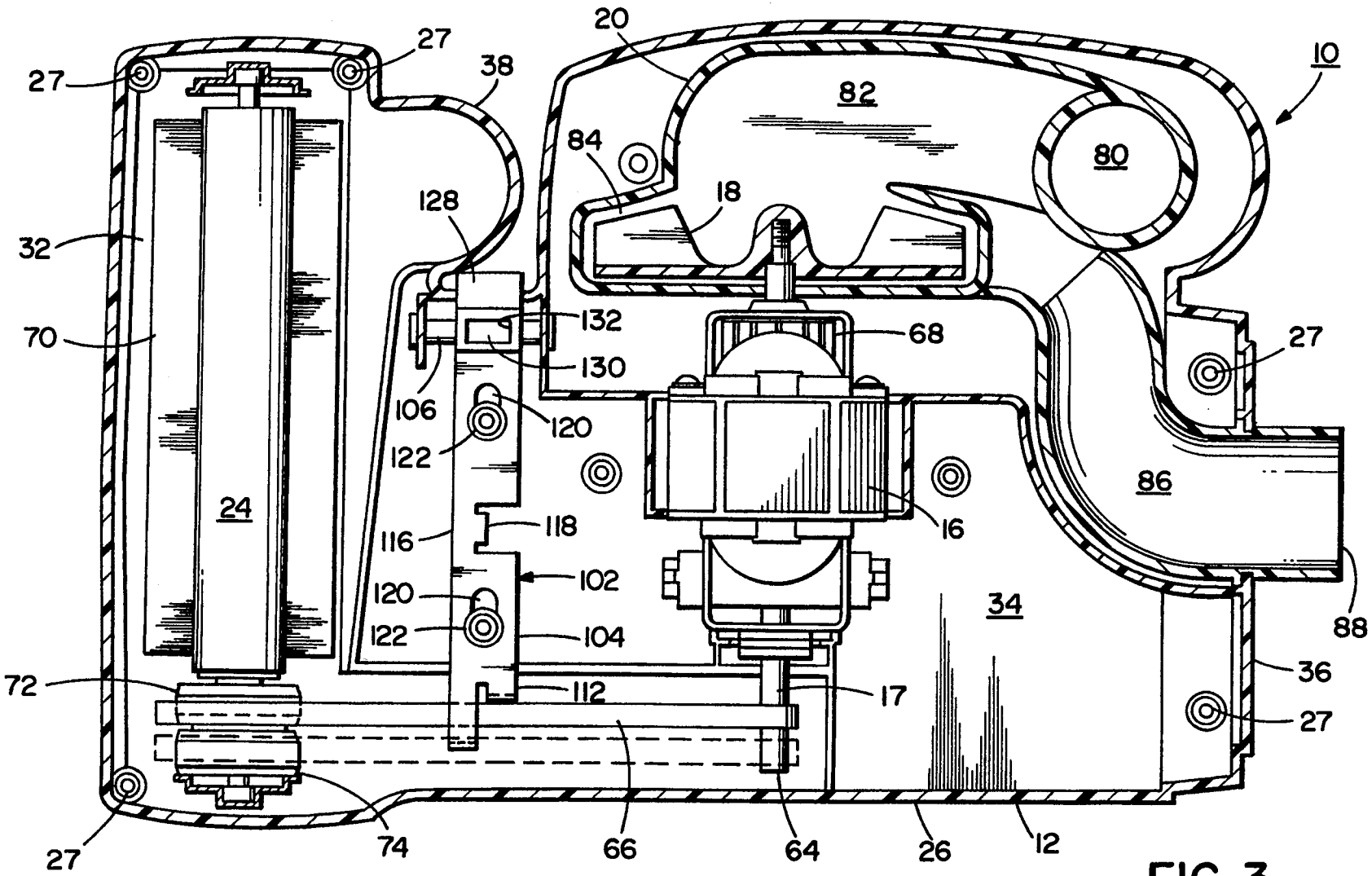
FIG. 3 is a schematic cross-sectional view of the vacuum cleaner shown in FIG. 1 taken along line 3—3.

As seen best with reference to FIGS. 2–4, the disengagement system 102 generally comprises a belt guide 104, an actuator 106, and a spring 108. The belt guide 104 is a one-piece member with a first end 110 connected to the actuator 106, a second end 112 with two spaced downwardly extending fingers 114, 115, and a middle section 116. The spacing between the fingers 114, 115 is slightly larger than the width of the belt 66. The belt 66, being located on the motor's drive shaft and the brush assembly 24, extends through the space between the two fingers 114, 115. The middle section 116 includes a flange 118 and two slots 120 on opposite sides of the flange 118. Portions 122 of the bottom and top housings 26, 28 come together at the slots 120 and form bosses to slidingly support, mount, and guide the belt guide 104 on the housing 12. The spring 108 is compressed between the flange 118 and a portion of the housing 12. This biases the belt guide 104 in a first position with the second end 112 located in a relatively outward location. The belt guide 104 can slidingly move, compressing the spring 108, to the second position shown in FIGS. 3 and 4 such that the second end 112 is located in a relatively inward location. The actuator 106 comprises a right angle member 124 with a pivot pin 126. Preferably, the actuator is a single member made of a molded polymer material. A first end 128 of the right angle member 124 extends out an aperture of the top housing 28 into a path of insertion of the hose front cuff 92 on the front nozzle 38. The pivot pin 126 is rotatably mounted to housing 12. A second end 130 of the right angle member 124 extends into a receiving aperture 132 of the first end 110 of the belt guide 104. When the front end of the hose 22 is mounted on the front nozzle 38, it pushes the first end 128 of the member 124 downward. This moves the second end 130 in the direction of arrow A in FIG. 4. This moves the belt guide 104 in the direction of arrow A and positions the second end 112 of the guide 104 at its second inward position. Since the belt 66 is located between the fingers 114,115, the belt 66 is pulled inward by the outer finger 115. When the front end of the hose 22 is removed from the front nozzle 38, the first end 128 of the right angle member 124 is able to move back up into the path of the cuff 92. The spring 108 is then able to push the belt guide 104 in the direction of arrow B to move the fingers 114, 115 from their second position to their first position. Since the belt 66 is located between the fingers 114, 115, the belt 66 is pushed outward by the inner finger 114.

As described above, the belt 66 is operably located between the motor's drive shaft 17 and the brush assembly 24. The drive pulley 72 and idler pulley 74 are both rotatably mounted at the intake section 32. The drive pulley 72 is suitably connected to the brush 70 to rotate the brush 70 when the drive pulley 72 is rotated. The idler pulley 74 is independently rotatably mounted such that the idler pulley 74 can be rotated without rotating the brush 70 or drive pulley 72. The idler pulley 74 is located outwardly from the drive pulley 72. The belt 66 is adapted to be moved between the pulleys 72, 74 by the fingers 114, 115 of the belt guide 104.

When the hose 22 is connected to the intake section 32, the system 102 retains the belt 66 in its inward position. In this inward position the belt 66 runs between the drive pulley 72 and an inner portion of the drive shaft 17 second end. The motor 16 is thus drivingly connected to the brush 70 by means of the belt 66 and drive pulley 72. When the hose 22 is not connected to the intake section 32, the system 102 retains the belt 66 in its outward position. In the outward position the belt 66 runs between the idler pulley 74 and an outer portion of the drive shaft second end as shown by the dotted lines in FIG. 3. Since the idler pulley 74 is independently rotatably mounted, rotation of the idler pulley 74 by the belt 66 does not drivingly rotate the drive pulley 72 or brush 70. Driving transmission of the brush 70 by the motor 16 is thus disengaged when the front end of the hose 22 is removed from the intake section 32. The system 102 is adapted to automatically move the belt 66 between its inward and outward positions dependent upon whether or not the front end of the hose 22 is connected to the intake section. In addition to increased safety, the belt disengagement system also increases efficiency of the motor 16 by reducing the load on the motor 16 when the hose is disconnected. This allows the motor 16 to provide even stronger air power. Of course, any suitable brush assembly transmission could be used and any suitable type of transmission disengagement could be envisioned from the description given above. The system 102 could also include a manual control, such as button 103, that could be actuated to disengage/reengage the brush transmission without disconnecting the cuff 92 from the collar 40.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A vacuum cleaner comprising:

an outer housing having a dirty air flow opening;

a source of vacuum located in the housing, the source of vacuum including a motor and an impeller; and a separable air chamber contained within the outer housing and surrounding the impeller, the air chamber being comprised of at least two half sections that form an outlet conduit having an entrance portion including a first section disposed generally perpendicular to and spaced from an entrance of the vacuum impeller and a second section disposed parallel to and adjacent the entrance of the impeller, said first and second sections being joined by a generally curved section, and an exit portion having a flow section disposed generally parallel to the first section of the entrance portion, an impeller chamber disposed downstream of said inlet conduit, the inlet conduit having a substantially constant cross-sectional area along its length, said inlet conduit communicating with said dirty air flow opening of said housing to provide a flow of dirty air into said air chamber.

2. A vacuum cleaner as in claim 1 wherein the outlet conduit has a cross-sectional area that expands along the length of the outlet conduit away from the impeller chamber.

3. A vacuum cleaner as in claim 1 wherein the at least two half sections comprise a top member and a bottom member, each of the top and bottom members forming half of the impeller chamber.

4. A vacuum cleaner as in claim 3 wherein the top and bottom members each form about half of the inlet conduit and the outlet conduit.

5. A vacuum cleaner as in claim 4 wherein the top member has an aperture to form an opening into the inlet conduit and is adapted to have an end of a vacuum hose connected to the top member at the aperture.

6. A vacuum cleaner as in claim 1 wherein at least one of the half sections has an aperture at the inlet conduit inside of the housing such that the source of vacuum can suck air into the source of vacuum from inside of the housing and expel the air from the housing to assist in removing heat from inside the housing.

7. A vacuum cleaner as in claim 1 wherein the inlet conduit has a general straight tube shape.

8. A vacuum cleaner as in claim 1 wherein the outlet conduit has a general expanding "S" shape.

9. A vacuum cleaner as in claim 1 wherein an opening into the inlet conduit and an exit from the outlet conduit are located at a same end of the air chamber.

10. A vacuum cleaner comprising:

an outer housing having a dirty air flow opening;

a motor connected to the housing, the motor having a first end with a vacuum impeller connected thereto and an opposite second end forming a drive shaft;

a rotatable brush assembly connected to the housing;

a drive belt connecting the rotatable brush assembly to the drive shaft of the motor; and a separate air chamber contained within the outer housing and surrounding the vacuum impeller, the air chamber having an inlet conduit including an entrance portion having a first section disposed generally perpendicular to and spaced from an entrance of the vacuum impeller and a second section disposed generally parallel to and adjacent the entrance of the vacuum impeller, said first and second sections being joined by a generally curved section and an exit portion having a flow section disposed generally parallel to the first section of the entrance portion said inlet conduit communicating with said dirty air flow opening of said housing to provide a flow of dirty air into said air chamber.

11. A vacuum cleaner as in claim 10, wherein the air chamber includes an inlet conduit, an outlet conduit, and an impeller chamber therebetween.

12. A vacuum cleaner as in claim 10 wherein the air chamber is comprised of two half sections connected to each other.

13. A vacuum cleaner as in claim 11 wherein the inlet conduit has a substantially constant cross-sectional area along its length.

14. A vacuum cleaner as in claim 11 wherein the outlet conduit has an expanding cross-sectional area along its length.

15. A vacuum cleaner conduit assembly, the vacuum cleaner having an outer housing having a dirty air flow opening, a motor supported within the housing and an impeller driven by said motor, the conduit assembly comprising;

a first half section; and a second half section connected to the first half section, the first and second half sections forming an inlet conduit including an entrance portion having a first section disposed generally perpendicular to and spaced from an entrance of the impeller and a second section disposed generally parallel to and adjacent the entrance of the impeller, said first and second sections being joined by a generally curved section, and an exit portion having a flow section disposed generally parallel to the first section of the entrance portion, an impeller chamber, the first and second half sections being contained within and separable from the outer housing, substantially surround the impeller in the impeller chamber, and provide an air flow pathway inside the housing to help prevent dirt from contaminating the motor, said first and second half sections of the air chamber providing an airflow barrier between said airflow pathway and said motor.

* * * * *